US011187074B2

(12) United States Patent
Martysevich et al.

(10) Patent No.: US 11,187,074 B2
(45) Date of Patent: Nov. 30, 2021

(54) DETERMINING WELLBORE PARAMETERS THROUGH ANALYSIS OF THE MULTISTAGE TREATMENTS

(71) Applicant: Halliburton Energy Services, Inc., Houston, TX (US)

(72) Inventors: Vladimir Nikolayevich Martysevich, Spring, TX (US); Joshua Lane Camp, Friendswood, TX (US); Tyler Austen Anderson, Huffman, TX (US); Srinath Madasu, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

(21) Appl. No.: 16/349,385

(22) PCT Filed: Jan. 13, 2017

(86) PCT No.: PCT/US2017/013495
§ 371 (c)(1),
(2) Date: May 13, 2019

(87) PCT Pub. No.: WO2018/132106
PCT Pub. Date: Jul. 19, 2018

(65) Prior Publication Data

US 2019/0330975 A1 Oct. 31, 2019

(51) Int. Cl.
*E21B 47/06* (2012.01)
*E21B 43/26* (2006.01)
(Continued)

(52) U.S. Cl.
CPC ..... *E21B 47/06* (2013.01); *E21B 43/26* (2013.01); *E21B 43/261* (2013.01); *E21B 47/10* (2013.01); *E21B 49/00* (2013.01)

(58) Field of Classification Search
CPC ..... E21B 43/26; E21B 47/06; E21B 43/261
See application file for complete search history.

(56) References Cited

U.S. PATENT DOCUMENTS 5,050,674 A 9/1991 Soliman et al.
5,442,173 A 8/1995 Wraight
(Continued)

FOREIGN PATENT DOCUMENTS

RU 2270335 C2 2/2006

OTHER PUBLICATIONS

International Search Report and Written Opinion, PCT/US2017/013495, dated Sep. 22, 2017, ISR/KR, 15 pages.
(Continued)

*Primary Examiner* — Robert E Fuller
(74) *Attorney, Agent, or Firm* — Haynes and Boone, LLP

(57) ABSTRACT

A system and method to determine closure pressure in a wellbore that can include, flowing a fracturing fluid into the wellbore during a fracturing operation of at least one stage and forming a fracture, sensing fluid pressure and a flow rate of the fracturing fluid during the fracturing operation and communicating the sensed data to a controller, plotting data points of the sensed data to a visualization device which is configured to visually present the data points to an operator as a plot, fitting a curve to the data points which represent statistically-relevant minimum pressure data at various flow rates, determining an intercept of the first curve with a zero flow rate axis of the plot, determining the closure pressure based on a pressure value of the intercept, and determining an average fracture permeability based on the closure pressure.

15 Claims, 10 Drawing Sheets

(51) Int. Cl.
*E21B 49/00* (2006.01)
*E21B 47/10* (2012.01)

(56) References Cited

U.S. PATENT DOCUMENTS

| | | | | |
|---|---|---|---|---|
| 6,705,398 | B2 | 3/2004 | Weng | |
| 8,838,427 | B2 | 9/2014 | Segal et al. | |
| 2003/0079875 | A1 | 5/2003 | Weng | |
| 2012/0158310 | A1 | 6/2012 | Adams et al. | |
| 2014/0058686 | A1 | 2/2014 | Anderson et al. | |
| 2014/0238663 | A1 | 8/2014 | Nieuwoudt et al. | |
| 2016/0258264 | A1* | 9/2016 | Lesko | E21B 47/06 |
| 2017/0370208 | A1* | 12/2017 | Dawson | E21B 7/06 |

OTHER PUBLICATIONS

Hou, et al., "A New Method for Evaluating the Injection Effect of Chemical Flooding," *Petroleum Science*, Aug. 2016, vol. 13, Issue 3, pp. 496-506.

* cited by examiner

DETERMINING WELLBORE PARAMETERS THROUGH ANALYSIS OF THE MULTISTAGE TREATMENTS

CROSS REFERENCE TO RELATED APPLICATION(S)

The present application is a U.S. National Stage patent application of International Patent Application No. PCT/US2017/013495, filed on Jan. 13, 2017, the disclosure of which is hereby incorporated by reference in its entirety.

TECHNICAL FIELD

The present disclosure generally relates to oilfield equipment and, in particular, to downhole tools, drilling and related systems and techniques for estimating formation and treatment parameters. More particularly still, the present disclosure relates to methods and systems for estimating formation and treatment parameters by collecting treatment data, such as pressure and fluid flow, and estimating formation and treatment parameters, such as closure stress, leakoff parameters, dynamic fracture permeability, average fracture width, average fracture length, size of diverter particles, limits for remedial treatment pressures and flow rates, friction regimes, and diverter efficiency.

BACKGROUND

In order to produce formation fluids from an earthen formation, wellbores can be drilled into the earthen formation to a desired depth. After drilling a wellbore, casing strings can be installed in the wellbore providing stabilization to the wellbore and keeping the sides of the wellbore from caving in on themselves. Multiple casing strings can be used in completion of a deep wellbore. A small space between a casing and untreated sides of the wellbore (generally referred to as an annulus) can be filled with cement. After the casing is cemented in place, perforating gun assemblies can be used to form perforations through the casing and associated cement, and into the earthen formation. (Of course, perforations can also be formed in uncased wellbores which do not have a casing or cement). A set of perforations can be referred to as a production stage, which includes a longitudinal distance along the wellbore at a location in the wellbore where formation fluids can be produced into a production string installed in the wellbore. As used herein, a "production stage" refers to a location along the wellbore where it is desirable to produce fluids, whether the location is in a vertical, a horizontal, or an inclined portion of the wellbore. Multiple perforations may be formed at each "production stage" to allow production fluids entrance into the wellbore. Some wellbores include multiple production stages at several locations along the wellbore.

Generally, multiple perforations are formed at each production stage, with each production stage being fractured at the perforations. The wellbore and/or perforations can be plugged before a next production stage is perforated, fractured, and plugged. This sequence can continue until all production stages in the wellbore are perforated and fractured. It should be understood that various sequences of fracturing the production stages can be performed, such as random and/or out of sequence fracturing operations that fracture a current stage and then can proceed to fracturing a next stage, with the next stage being above or below the current stage. When all the stages are perforated and fractured, the plugging material (or plugs) can be removed from the wellbore to facilitate production of formation fluids. However, proppant deposited in the fractures can remain in the fractures to keep them from closing.

A fracturing operation can require several design parameters (e.g. fracture closure pressure, fracture gradient, fluid leakoff coefficient, fluid efficiency, formation permeability, formation conductivity, formation flow capacity, reservoir pressure, an expected fracture geometry, etc.) to be determined and/or estimated prior to initiating the operation. Estimating these parameters can be based on data from similar formations, simulations, etc. and can help the fracturing operation begin within suitable ranges for these parameters, but these estimates may not be accurate for the current wellbore. Actual testing of the wellbore can be performed to determine these parameters, such as a minifrac test, which is a small fracturing treatment performed before the main hydraulic fracturing treatment to acquire job design and execution data and confirm a predicted response of the treatment interval. The intent is to break down the formation to create a short fracture during the injection period, and then to observe closure of the fracture system during the ensuing falloff period. These tests can be performed to obtain the design parameters. However, the minifrac tests can take valuable well system time in addition to the actual treatment time.

Therefore, it will be readily appreciated that improvements in the arts of determining design parameters for fracturing operations are continually needed.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
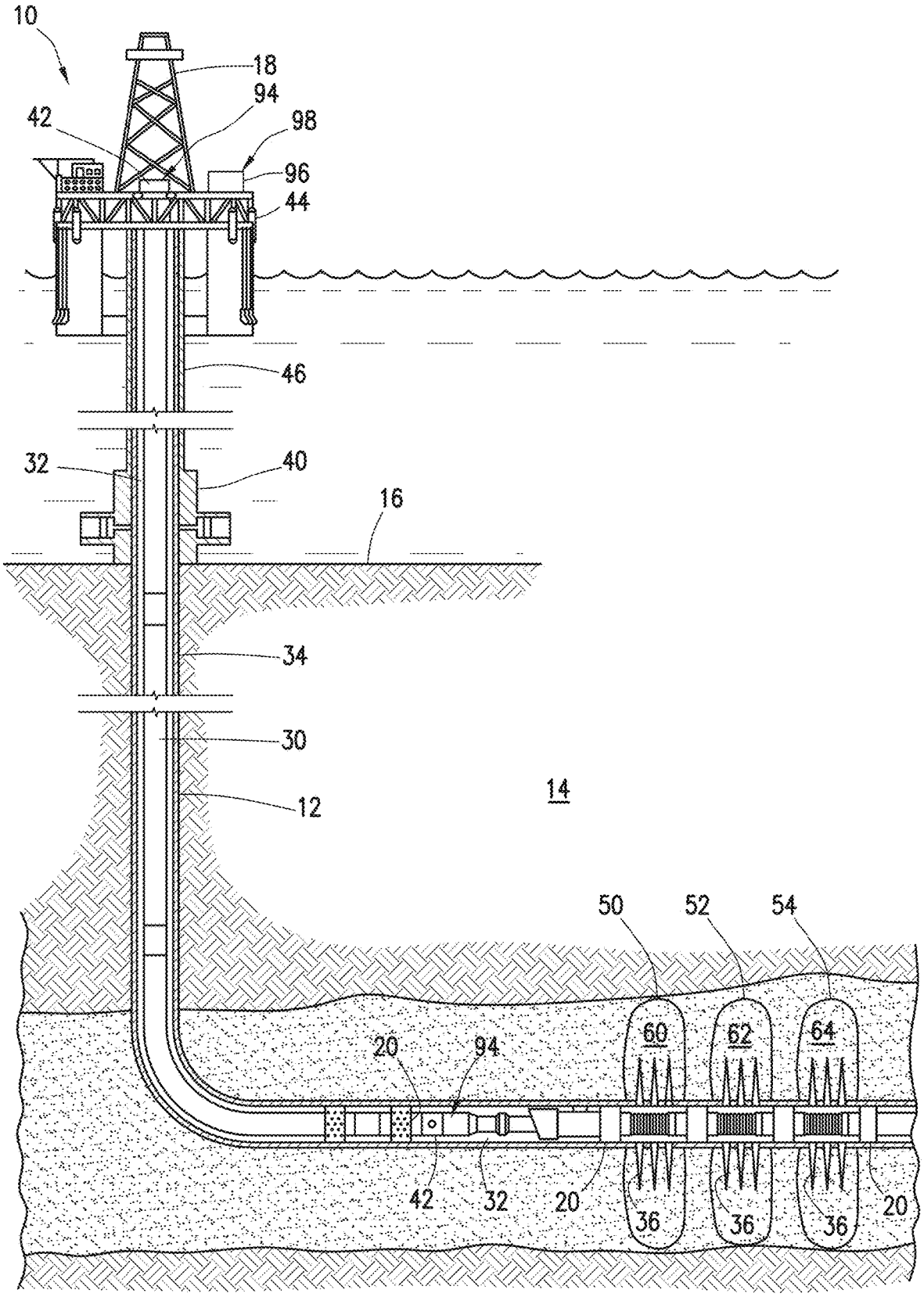
FIG. 1 is a representative partial cross-sectional view of a marine-based well system which can benefit from an embodiment of a system of the current disclosure that can determine fracturing operation design parameters during the fracturing process.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a horizontal wellbore or a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depict an offshore operation, it should be understood by those skilled in the art that the method and/or system according to the present disclosure is equally well suited for use in onshore operations and vice-versa. Further, unless otherwise noted, even though a Figure may depict a cased hole, it should be understood by those skilled in the art that the method and/or system according to the present disclosure is equally well suited for use in open hole operations and/or other types of well completions (e.g. liners, slotted liners, sliding and pre-perforated sleeves, screens, etc.).

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. It should also be understood that, as used herein, "first," "second," and "third," are assigned arbitrarily and are merely intended to differentiate between two or more objects, etc., as the case may be, and does not indicate any sequence. Furthermore, it is to be understood that the mere use of the word "first" does not require that there be any "second," and the mere use of the word "second" does not require that there be any "first" or "third," etc.

The terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

Generally, this disclosure provides a system and method to determine closure pressure and/or an average fracture permeability that can include, flowing a fracturing fluid into the wellbore during a fracturing operation of at least one stage and forming a fracture, sensing fluid pressure and a flow rate of the fracturing fluid during the fracturing operation and communicating the sensed data to a controller, plotting data points of the sensed data to a visualization device which is configured to visually present the data points to an operator as a plot, fitting a curve to the data points which represent statistically-relevant minimum pressure data at various flow rates, determining an intercept of the first curve with a zero flow rate axis of the plot, determining the closure pressure based on a pressure value of the intercept, and determining an average fracture permeability based on the closure pressure.

FIG. 1 shows an elevation view in partial cross-section of a wellbore production system 10 which can be utilized to produce hydrocarbons from wellbore 12. Wellbore 12 can extend through various earth strata in an earth formation 14 located below the earth's surface 16. Production system 10 can include a rig (or derrick) 18. The rig 18 can include a hoisting apparatus, a travel block, and a swivel (not shown) for raising and lowering casing, or other types of conveyance vehicles 30 such as drill pipe, coiled tubing, production tubing, and other types of pipe or tubing strings, as well as wireline, slickline, and the like. In FIG. 1, the conveyance vehicle 30 is a substantially tubular, axially extending work string or production tubing, formed of a plurality of pipe joints coupled together end-to-end supporting a completion assembly as described below. However, it should be understood that the conveyance vehicle 30 can be any of the other suitable conveyance vehicles, such as those mentioned above. The conveyance vehicle 30 can include one or more packers 20 to prevent (or at least restrict) flow of production fluid through an annulus 32. However, packers 20 are not required.

Sensors 92 and 94 can be used to collect wellbore parameters (pressure, temperature, strain, etc.) as well as fluid parameters (pressure, temperature, flow rate, etc.). In FIG. 1, one or more sensors 94 can be used to collect the slurry rate of the fracturing fluid 70 that flows into the conveyance 30 during fracturing, and one or more sensors 92 can be used to collect bottom-hole pressure measurements during completion and production operations. A controller 98 can have a visualization device 96 (display, plotter, printer, hologram projector, heads-up display, etc.) used to display various well system data, such as pressure, temperature, flow rates, etc. The controller 98 can receive data from the one or more sensors 92, 94 and format the sensor data for display on the device 96. The controller 98 can transform the sensor data from electrical signals transmitted by the sensors 92, 94 to light signals radiated from the display and organized in a visual orientation so as to visually communicate the sensor data to an operator. The controller 98 can also transform the sensor data from electrical signals transmitted by the sensors 92, 94 to instructions to a printer, plotter, projector, such that an image is created which can visually communicate the sensor data to an operator.

The wellbore production system 10 in FIG. 1 is shown as an offshore system. A rig 18 may be mounted on an oil or gas platform, such as the offshore platform 44 as illustrated, and/or semi-submersibles, drill ships, and the like (not shown). One or more subsea conduits or risers 46 can extend from platform 44 to a subsea wellhead 40. The tubing string 30 can extend down from rig 18, through subsea conduits 46, through the wellhead 40, and into wellbore 12. However, the wellbore production system 10 can be an onshore wellbore system, in which case the conduits 46 may not be necessary.

Wellbore 12 may be formed of single or multiple bores, extending into the formation 14, and disposed in any orientation (e.g. vertical, inclined, horizontal, combinations of these, etc.). The wellbore production system 10 can also include multiple wellbores 12 with each wellbore 12 having single or multiple bores. The rig 18 may be spaced apart from a wellhead 40, as shown in FIG. 1, or proximate the wellhead 40, as can be the case for an onshore arrangement. One or more pressure control devices (such as a valve 42), blowout preventers (BOPs), and other equipment associated with drilling or producing a wellbore can also be provided in the system 10. The valve 42 can be a rotating control device proximate the rig 18. Alternatively, or in addition to, the valve 42 can be integrated in the tubing string 30 to control fluid flow into the tubing string 30 from an annulus 32, and/or controlling fluid flow through the tubing string 30 from upstream well screens.

Multiple production stages 60, 62, 64 are shown in a horizontal portion of the wellbore 12. Fractures 50, 52, 54 for stages 60, 62, 64, respectively, are shown radially extending from perforations 36 into the formation 14. The wellbore system 10 is shown in a production configuration after a completion operation has been performed on the wellbore 12. A production string 30 with multiple screen assemblies positioned at each stage 60, 62, 64 is shown where fluids from the formation 14 can enter the production string 30 through the screen assemblies and be produced to the surface 16 and/or rig 18. It should be understood that FIG. 1 depicts only one possible example of a production system 10 and that system 10 can include more or fewer components than those shown in FIG. 1. For example more or fewer production stages can be included in the system 10 as well as more or fewer screen assemblies, multiple stages can supply formation fluids to a single screen assembly, and a single stage can supply formation fluids to multiple screen assemblies. Additionally, screen assemblies can be surrounded by a gravel pack with the packers 20 replaced with centralizers, or the production system 10 may not include screen assemblies. Those skilled in the relevant art will clearly understand the various configurations of the system 10 that are possible in keeping with the principles of this disclosure.

Figure 2:
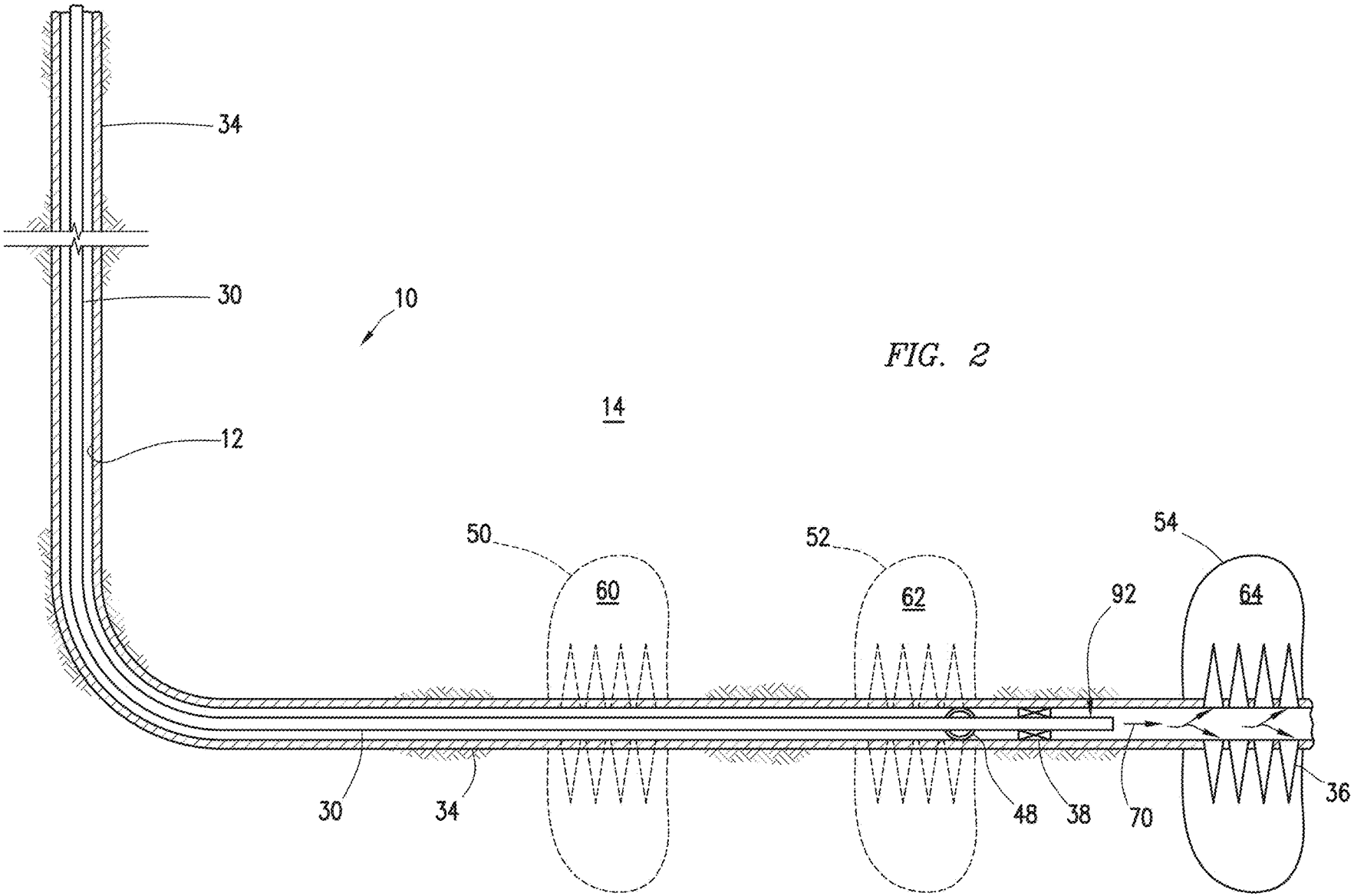
FIG. 2 is a representative partial cross-sectional view of a portion of the wellbore of FIG. 1 with a work string installed in the wellbore at a desired location.
Figure 3:
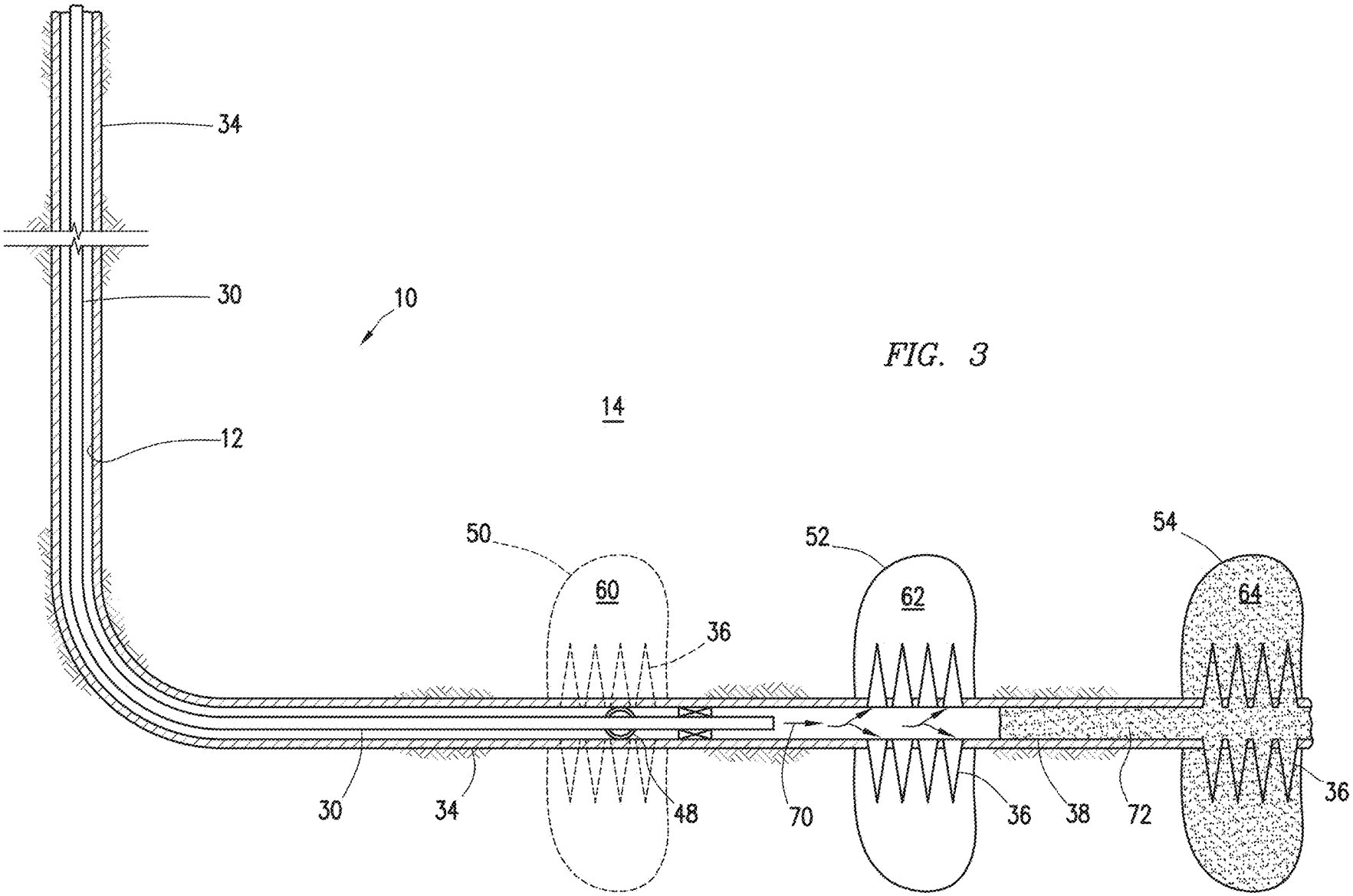
FIG. 3 is a representative partial cross-sectional view of the portion of the wellbore of FIG. 1 with the work string installed in the wellbore at another desired location after a stage has been fractured.

In performing the completion operation on the wellbore 12, multiple fracturing operations can be used to form fractures 50, 52, 54. Generally, these fractures are formed sequentially one at a time starting with the lowermost stage 64 and working up to the uppermost stage 60. There are also several methods and systems available for performing fracturing operations on multiple production stages out of sequence, such as fracturing an upper production stage then fracturing a lower production stage, and/or randomly selecting the order of fracturing the stages 60, 62, 64. One possible process for fracturing the stages 60, 62, 64 is shown in FIGS. 2 and 3 and described below. However, several other fracturing processes may be used instead of or in addition to the process illustrated in FIGS. 2 and 3. It should be understood that the principles of this disclosure can be utilized by many different processes for fracturing single or multiple production stages.

FIG. 2 shows a partial cross-sectional view of a portion of the wellbore 12 with perforations 36 having been formed at stage 64. Any stages below stage 64 may have already been fractured and plugged such as with a bridge plug, diverter plug, etc. Assuming a bridge plug has been installed below the stage 64 (that is if other stages below stage 64 have been fractured and plugged), then the fracturing of the stage 64 can begin. A work string 30, with a centralizer 48 and a resettable packer 38, has been installed in the wellbore 12 and packer 38 has been set to prevent a fracturing fluid 70 from flowing along the annulus 32 to other stages above the stage 64. The dashed lines in FIG. 2 for fractures 50, 52 and perforations 36 indicate future locations for these items, since they have not yet been formed in this example. With the packer 38 set and the wellbore configured to divert fluid 70 into the perforations 36 at the stage 64, the fracture 54 can be formed by pumping the fluid 70 through the work string 30 and into the perforations 36. To successfully form the desired fracture 54 with desired geometries (e.g. length, width, etc.), an operator may need to know parameters such as fracture closure pressure, fracture gradient, fluid leakoff coefficient, fluid efficiency, formation permeability, formation conductivity, formation flow capacity, reservoir pressure, etc. As mentioned above, these parameters can be determined by performing a pre-test operation (e.g. a minifrac test) which can require one or more trips in and out of the wellbore before the desired parameters are known and a fracturing operation designed based on these parameters. However, these extra trips in and out of the wellbore 12 can consume valuable wellbore system 10 time possibly increasing expenses for fluid production.

However, as provided in this disclosure, these parameters can be determined and continually updated during the fracturing operation without requiring separate test operations prior to beginning the fracturing operations. In this approach, a fracturing operation is designed with estimated parameters that can be obtained through simulations, historical data from other wellbores and similar earthen formations, logged data from the current wellbore 12, etc. Once these estimated parameters are incorporated into the fracturing operation design, then the operator can begin a fracturing operation for a particular stage, such as stage 64 which is shown being fractured in FIG. 2. As the fracturing fluid 70 is pumped through the work string 30, parameters of the pumped fluid 70 (such as flow rate, fluid pressure downhole, proppant concentration, etc.) can be recorded at periodic intervals as the fracturing operation progresses. Pressure measurements of the fluid 70 at or near the earth's surface can be used instead of downhole pressure measurements, but corrections for hydrostatic and friction loses may need to be applied. Periodic intervals can be on the order of milliseconds, seconds, minutes, etc. From this recorded data, adjustments to the fracturing design parameters can be verified and/or modified to more accurately represent the actual characteristics of the wellbore 12 and the surrounding formation 14. This approach is an improvement over current wellbore fracturing operations by minimizing and/or eliminating the need for testing (such as the minifrac tests) to determine fracturing process design parameters prior to beginning fracturing operations.

As the fracturing process for stage 64 begins, a proppant laden fluid 70 can be pumped at a desired pressure into the perforations 36 at stage 64. Generally, the characteristics of each perforation 36 and the formation into which the perforation extends can vary between each perforation 36. Therefore, at the same fluid pressure, some perforations may accept more fluid 70 than others in stage 64 possibly causing variations in fracture geometries. Some flow paths through the perforations may accept too much flow thereby hampering the fracturing process by preventing adequate pressure build up necessary for forming the fracture 54. It can be desirable to cause each perforation 36 to accept generally the same amount of fluid 70 at generally the same pressure.

This can be accomplished by depositing diverter particulates in the perforations and any fractures that are formed. Perforations that accept larger amounts of the fluid 70 will also receive larger amounts of diverter particulates, thereby increasingly restricting the flow of fluid 70 at a greater rate than perforations that accept less of the fluid 70. This may result in average fluid flow through each of the perforations, and therefore, can result in more uniform fracturing geometries for fracture 54. Throughout the fracturing process of stage 64, data points of pressure and flow rate (and/or fluid volume pumped) can be collected at periodic intervals (e.g. milliseconds, seconds, etc.) and recorded in a database in a processing system, displayed on a computer screen of the processing system, transmitted to a remote processing system, etc. The recorded data can be used to determine actual fracturing process parameters and refine the fracturing process design while fracture 54 is being formed. The actual fracturing process parameters can include such things as closure stress, leak-off parameters, dynamic fracture permeability, average fracture width, average fracture length, size of diverter particles (and/or proppant), limits for remedial treatment pressures and rates, understanding friction regimes, diverter efficiency criteria, etc. These actual parameters can be used to provide a more accurate fracturing process design for subsequent stages in the wellbore 12, such as stages 62, 60.

After the fracture 54 has been formed, it may be desirable to perform additional perforating and fracturing operations of additional stages (e.g. stages 62, 60). With the actual fracturing process parameters determined from fracturing stage 64, more accurate fracturing process designs can be established for these additional stages. With the principles of this disclosure, the fracturing process design of the additional stages can be rechecked and modified as needed while the fracturing operations are in progress.

To progress to the next stage 62, it is normally desirable to plug the previous stage by installing a plugging material 72 (e.g. bridge plug, frac plug, organic material, diverter particulates, etc.) between the stages 64 and 62. Plugging the stage 64 prevents (or at least minimizes) fracturing fluid 70, intended for fracturing stage 62, from being lost in the previously fractured stage 64. This plugging material 72 can be a frac plug and/or a bridge plug installed in the wellbore 12, as well as various other methods for diverting the fracturing fluid 70 away from the production stage 64 and into the perforations 36 in the production stage 62 for forming the fracture 52, such as depositing diverter particulates in the fracture and/or perforations. Again, data points of pressure and flow rate (and/or fluid volume pumped) can be collected at periodic intervals and recorded in a database in a processing system (e.g. a controller 98), displayed on a computer screen of the processing system, transmitted to a remote processing system, etc. The recorded data can be used to determine actual fracturing process parameters and refine the fracturing process design while fracture 52 is being formed. The actual fracturing parameters for stage 62 can be different than the parameters for stage 64. Therefore, this process provides improvement over other methods and systems in that the fracturing parameters can be continually refined throughout the fracturing of multiple stages in the wellbore 12.

Figure 4:
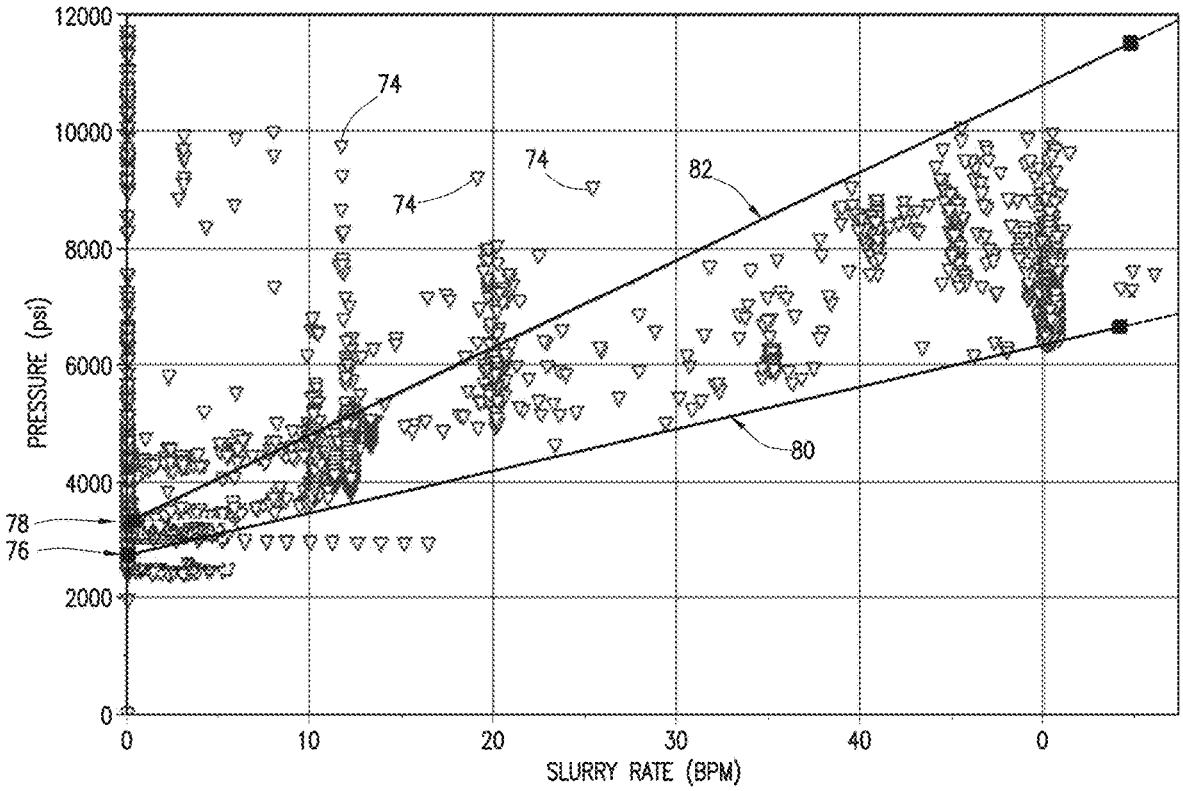
FIG. 4 is representative plot of a slurry flow rate for a treatment fluid vs. pressure of the treatment fluid for an example fracturing operation in a wellbore.

FIG. 4 shows a representative plot of data points 74 taken during fracturing processes of one or more of the stages 60, 62, 64. The data points 74 represent measurements of pressure vs. slurry flow rate of the fracturing fluid 70 as it is being pumped into the wellbore 12 to form one or more fractures 50, 52, 54. As a fracturing process progresses, data points 74 are continuously collected by collecting pressure and slurry flow rate measurements at regular time intervals. As used herein, "continuously" refers to an ongoing activity during the fracturing process, even though there may be periods of time that measurements are not being collected. Generally, while the fracturing process is active, data points 74 are being collected at the regular time intervals (milliseconds, seconds, minutes, etc.). When the fracturing process stops, then data point 74 collection may also stop. However, it is not required that the data point 74 collection start when fracturing is started or stop when fracturing is paused or stopped. Data points 74 collected while the fracturing process is stopped (or temporarily paused) will generally be plotted along the "zero" slurry flow rate line, which can somewhat be illustrated by the data points 74 that are shown in FIG. 4 positioned along the "zero" slurry flow rate line.

As the fracturing process continues, more and more data points 74 can be collected and plotted, and yielding a representative distribution as seen in FIG. 4. With this distribution of points 74, the closure pressure $P_C$ can be estimated by fitting a curve 80 (e.g. a line 80 shown in FIG. 4) along the lower points 74, such that the curve 80 may have a greater number of points intersecting the line than simply intersecting the lowest points 74 with the curve. As can be seen, a cluster of points 74 at the slurry flow rate ~50 BPM appears to have a few points below the curve 80. By letting a few points 74 lay below the curve 80, the curve can better intersect more lower points 74 along a wider range of slurry flow rates, thereby increasing the accuracy of a closure pressure estimate. Once the curve has been fitted along the lower points, the curve can be extended until it intersects the "zero" slurry flow rate axis. The value at the intersection of the curve 80 and the "zero" slurry flow rate axis is the estimated closure pressure. This estimated closure pressure can more accurately indicate the actual closure pressure of the formation 14 at a particular stage in the wellbore 12 than estimates provided prior to obtaining the actual fracturing process data points 74.

For purposes of discussion, the example given in FIG. 4 can be analyzed further to determine various fracturing process parameters that could be used to improve the ongoing fracturing process and/or future fracturing processes. Various ones of these parameters can be determined based on the closure pressure $P_C$. With the curve 80 fitted to the lower points 74, a slope of the curve 80 can be determined, that is if the curve is a line as seen in FIG. 4. If the curve is not a line, then a function that describes the curve 80 can be formulated and used to calculate a closure pressure $P_C$. However, for this example, the curve 80 is a line 80 and the slope for this line 80 can be determined, which is given to be 72.01 in this example.

To determine a closure pressure $P_C$ of a formation 14 at a particular stage, such as stages 60, 62, 64, the data points 74 can be collected during the fracturing process. With a sufficient amount of data points 74 collected, the closure pressure $P_C$ can be estimated based on lower data points 74 for various slurry flow rates. This can be referred to as "statistically-relevant minimum pressure" data points 74 for the various slurry flow rates. As used herein, "statistically-relevant minimum pressure" refers to the lowest data point 74 for multiple slurry flow rates that can be intersected by a curve 80 (e.g. a line) through the other lower data points for other ones of the multiple slurry flow rates. The curve 80 is established such that it intersects a representative number of the data points 74 that are proximate the lowest data points 74 for each slurry flow rate (or at least representative sampling of slurry flow rates spanning the slurry flow rate range of the plot). With the curve 80 established, then the closure pressure $P_C$ can be determined by determining where the curve 80 intersects the "zero" slurry flow rate axis. This intercept point 76 of the flow rate axis provides the estimated closure pressure $P_C$ of the current stage being fractured and/or a stage that has already been fractured.

A slope of the curve 80 can be determined in this example from a visualization tool (e.g. display, hardcopy plot, etc.) by fitting the curve to the data points 74 for statistically-relevant minimum pressure at various slurry flow rates. In this example, the curve 80 is a line. Equation (1) below can represent the equation for the line 80, where the slurry rate is a function of pressure:

$$\dot{Q} = \frac{\pi(1-v^2)h_f L_f^2}{2t_{pump}E}(P - P_C) \tag{1}$$

Where $\dot{Q}$ is the slurry rate, $h_f$ is the fracture height, $L_f$ is the fracture half length, E is the Young's modulus, $t_{pump}$ duration of time the stage pump is pumping, v is the Poisson's ratio, P is the bottom hole pressure assuming negligible friction in the fracture and $P_C$ is the closure pressure obtained from the intercept point 76 of the line 80 with the "zero" slurry flow rate line.

As shown by Equation (1) above, the $slope_{80}$ for the curve 80 (or line 80 in this example) can be represented by Equation (2) below:

$$slope_{80} = \frac{\pi(1-v^2)h_f L_f^2}{2t_{pump}E} \tag{2}$$

The fracture height $h_f$, Young's modulus E, Poisson's ratio v can be obtained from historical data. The $slope_{80}$ can be determined directly from the fitted line 80, thus yielding a value for the $slope_{80}$. With the value of the $slope_{80}$ also known, then Equation (2) can be used to determine the average fracture half length $L_f$, which can be hundreds of meters long, such as the "Cordell" formation which is estimated at 344 meters long.

The average fracture half length $L_f$ can then be used to calculate a dynamic average fracture width $w_f$ represented by Equation (3) below:

$$w_f = \frac{2(1-v^2)L_f}{E}(P - P_C) \tag{3}$$

The dynamic average width $w_f$ can be used to calculate in real time a desired size for diverter particulates 72 which can be pumped along with the fracturing fluid 70. When it is desired to divert the fracturing fluid, an appropriate bridging criteria for the diverter particulates 72 to enter the fracture, such as $d_p/w_f>1$ where $d_p$ is the average particle size ($d_{50}$), can be used to determine desired diverter particulates 72 used to help ensure proper diversion when pumped with the fracturing fluid 70.

As the pressure and slurry rate are increased during the fracturing process, a fracture (e.g. fractures 50, 52, 54) can be formed. The clustering of data points 74 can be seen in FIG. 4 at the slurry flow rate of ~50 BPM. This Slurry Rate in this example indicates the flow rate at which the bulk of the fracturing is performed as well as proppant being deposited into the newly formed fracture. As the fracturing process for a stage is nearing the end, a ramping down of the pressure and slurry rate is performed. During this ramp down procedure, the pressure is measured at various points at very small flow rate increments or decrements (on the order of 2-30 BPM) and plotted as additional data points 74. A curve 82 (which is represented in this example as a line 82) can be fitted to data points 74 at "statistically-relevant maximum pressure" for the various slurry flow rates.

The slurry rate can also be represented by the Equation (4) below:

$$\dot{Q} = \frac{K_f w_f h_f}{\mu L_f}(P - P_C) \tag{4}$$

Where $\dot{Q}$ is the slurry rate, $h_f$ is the average fracture height, $w_f$ is the dynamic average width, $L_f$ is the average fracture half length, $K_f$ is the average fracture permeability, μ is the fracturing fluid viscosity, P is the bottom hole pressure assuming negligible friction in the fracture and $P_C$ is the closure pressure obtained above from the intercept point 76 of the line 80 with the "zero" slurry flow rate line. The $slope_{82}$ can be used to compute the average fracture permeability $K_f$ as given by equation (5) below $$slope_{82} = \frac{K_f w_f h_f}{\mu L_f} \tag{5}$$

The $slope_{82}$ can be determined directly from the fitted line 82, thus yielding a value for the $slope_{82}$, and then Equation (5) can be used to determine the average fracture permeability $K_f$. Additionally, Fracture Conductivity can be estimated using the average fracture permeability $K_f$ and the dynamic average width $w_f$.

FIGS. 5-9 represent a plot of data points 74 taking for an example wellbore 12 with 44 stages that were fractured during completion operation for the wellbore. Please note that these stages can be fractured one at a time in any order, and multiple stages can be fractured simultaneously in keeping with the principles of this disclosure. The data points 74 in FIGS. 5-9 can be a down-sampling of the actual collected data points 74. For example, data points 74 may be collected every millisecond, but a filter may be used on the data points 74 to filter out all points but those in a regular time period, such as a second, minute, multiple minutes, an hour, etc. By using a reduced amount of the collected data points 74, processing can be faster, yielding results faster. However, it is not a requirement that the data points 74 be down-sampled. These real-time process enhancements can be determined using the entire database of data points 74 collected.

Figure 5:
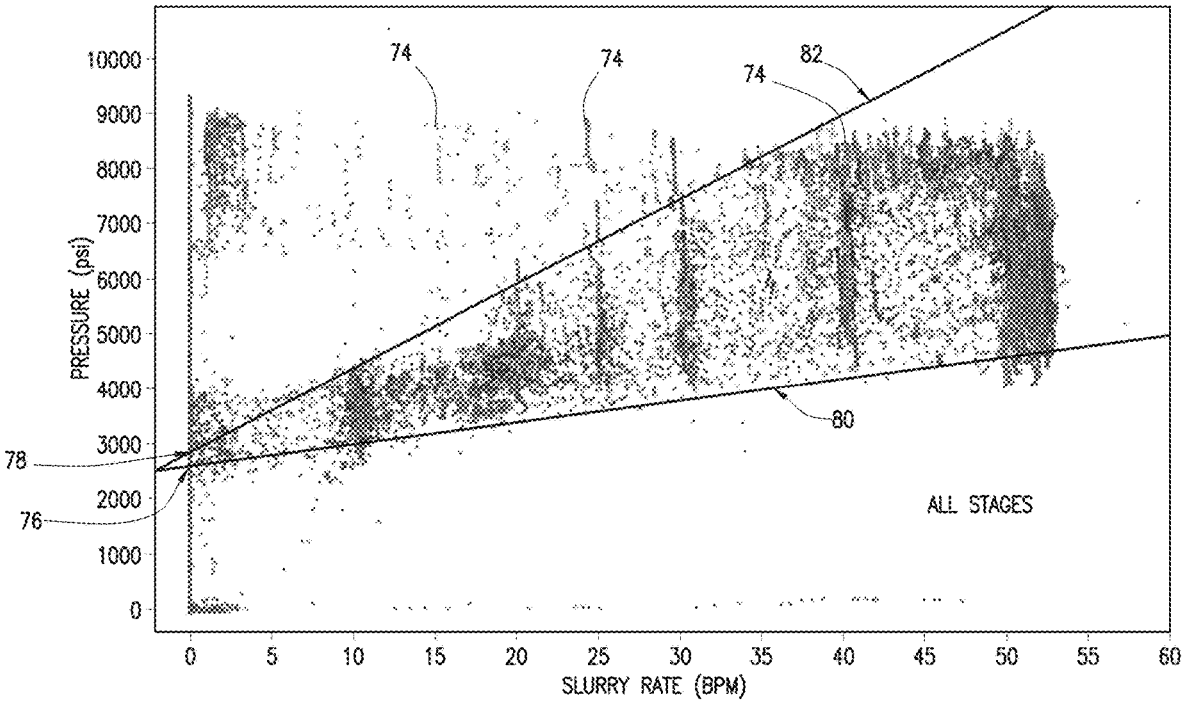
FIG. 5 is a representative plot of a slurry flow rate for a treatment fluid vs. pressure of the treatment fluid for all stages of a fracturing operation in a wellbore.

FIG. 5 shows a plot of a down-sampled set of data points 74 for the fracturing processes for all 44 stages of the wellbore 12 example. A curve 80 is fitted to the statistically-relevant minimum pressure data points 74 for the various slurry flow rates. The $slope_{80}$ for this example is determined to be 39.79, with the closure pressure $P_C$ determined by the intercept point 76 of the fitted curve 80 at the "zero" slurry flow rate line, which is given as 2591 in this example. The $slope_{82}$ for this example is determined to be 153.5. From these values and the Equations (1)-(5), the average fracture permeability $K_f$ of the example wellbore 12 can be determined as well as other parameters, such as fracture conductivity, fracture gradient, fluid leakoff coefficient, fluid efficiency, formation permeability, formation conductivity, formation flow capacity, reservoir pressure, expected fracture geometries, etc.

Figure 6:
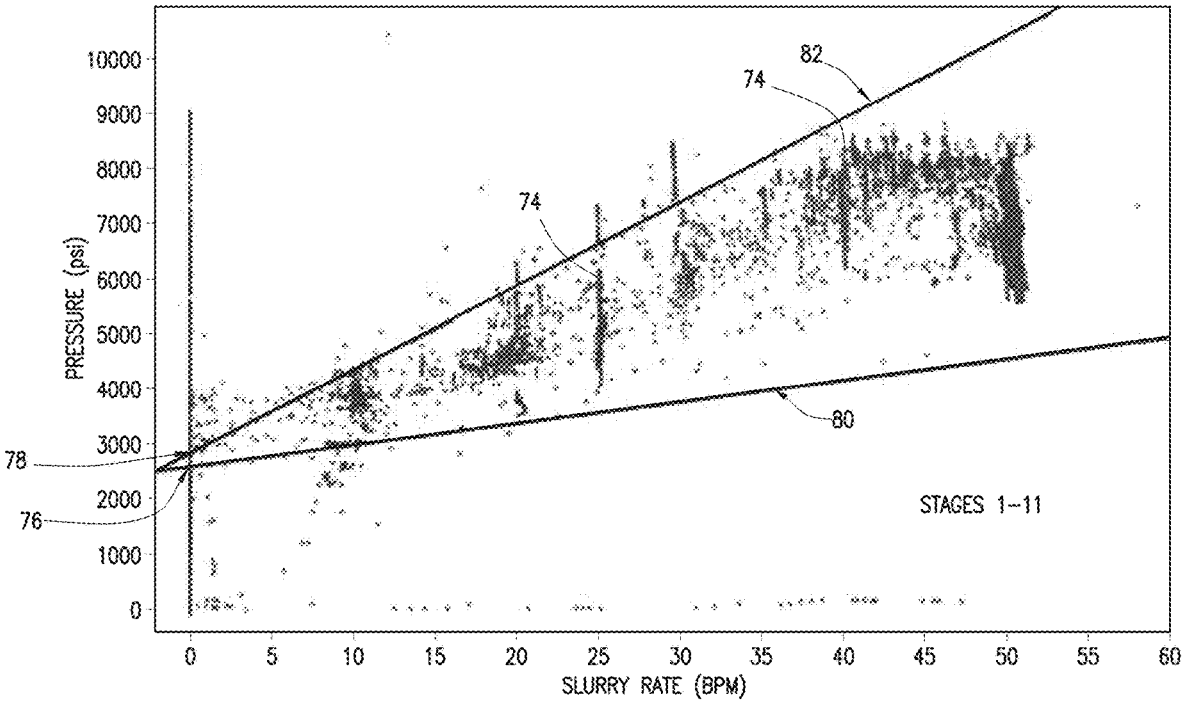
FIGS. 6-9 are representative plots of a slurry flow rate for a treatment fluid vs. pressure of the treatment fluid for a subset of all stages of the fracturing operation in the wellbore.
Figure 7:
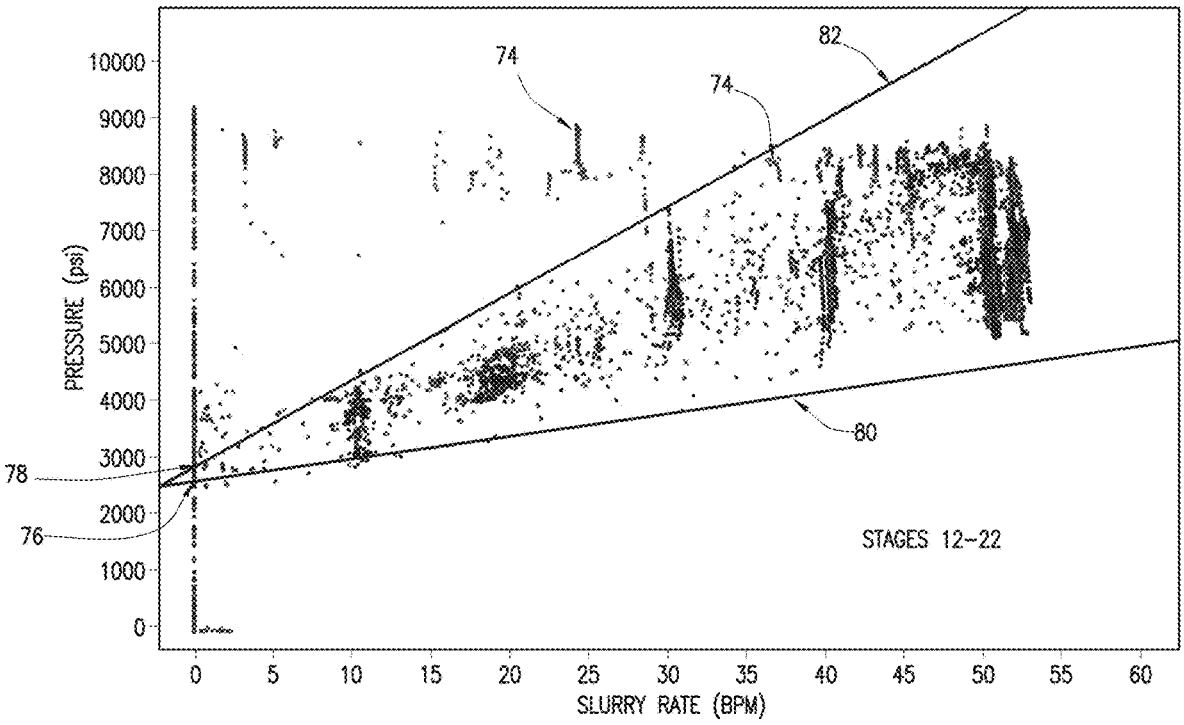
Figure 8:
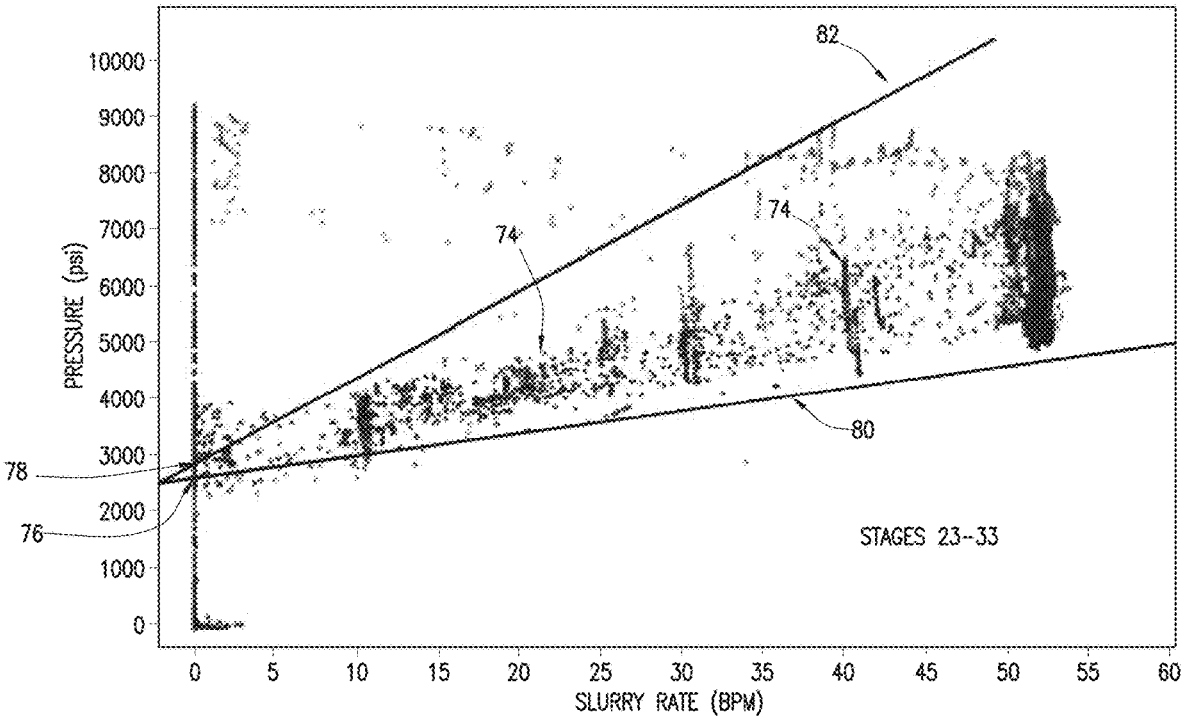
Figure 9:
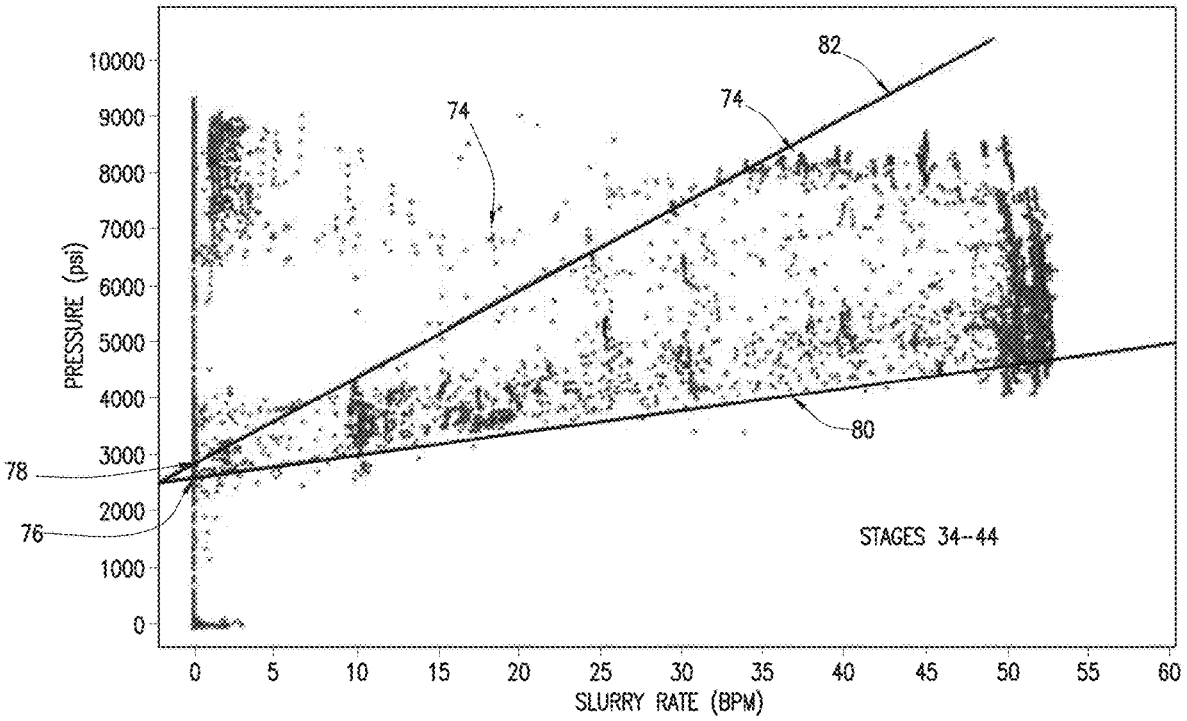

FIGS. 6-9 show a plot of a down-sampled set of data points 74 for a subset of fracturing processes for the 44 stages of the wellbore 12 example. FIG. 6 shows a set of data points 74 for the fracturing processes for stages 1-11. FIG. 7 shows a set of data points 74 for the fracturing processes for stages 12-22. FIG. 8 shows a set of data points 74 for the fracturing processes for stages 23-33. FIG. 9 shows a set of data points 74 for the fracturing processes for stages 33-44. The fitted curves 80 and 82 from FIG. 5 are shown in FIGS. 6-9 for reference. It can be seen in each one of FIGS. 6-9 that other possible curves 80 and/or 82 can be fitted to the plotted data points 74, possibly resulting in different values for $slope_{80}$ and/or $slope_{82}$. Therefore, it can easily be seen that the fracturing process designs for different stages of the wellbore 12 can be modified in real time per the measurements taken in each stage and in the determinations made based on those measurements.

When fracturing multiple stages in a wellbore 12 in a single trip in the wellbore as well as multiple perforation clusters within a stage, it may be desirable to divert the fracturing fluid 70 away from a fracture that has already been formed in one stage to perforations in another stage (or another perforation cluster in the same stage) where the next fracture is to be formed. This diversion process can be used to restrict flow of the fracturing fluid 70 from existing fractures sufficiently enough to allow downhole pressure to increase to a point that the fracturing fluid can fracture the next stage (or perforation cluster). If flow is not sufficiently restricted, downhole pressure may not increase to a fracturing pressure, thereby preventing further fracturing. Therefore, it can be valuable to determine if the diversion process was successful in forming a diversion that sufficiently restricts flow of fracturing fluid 70 to any existing fractures and/or loss zones in the wellbore 12.

Figure 10:
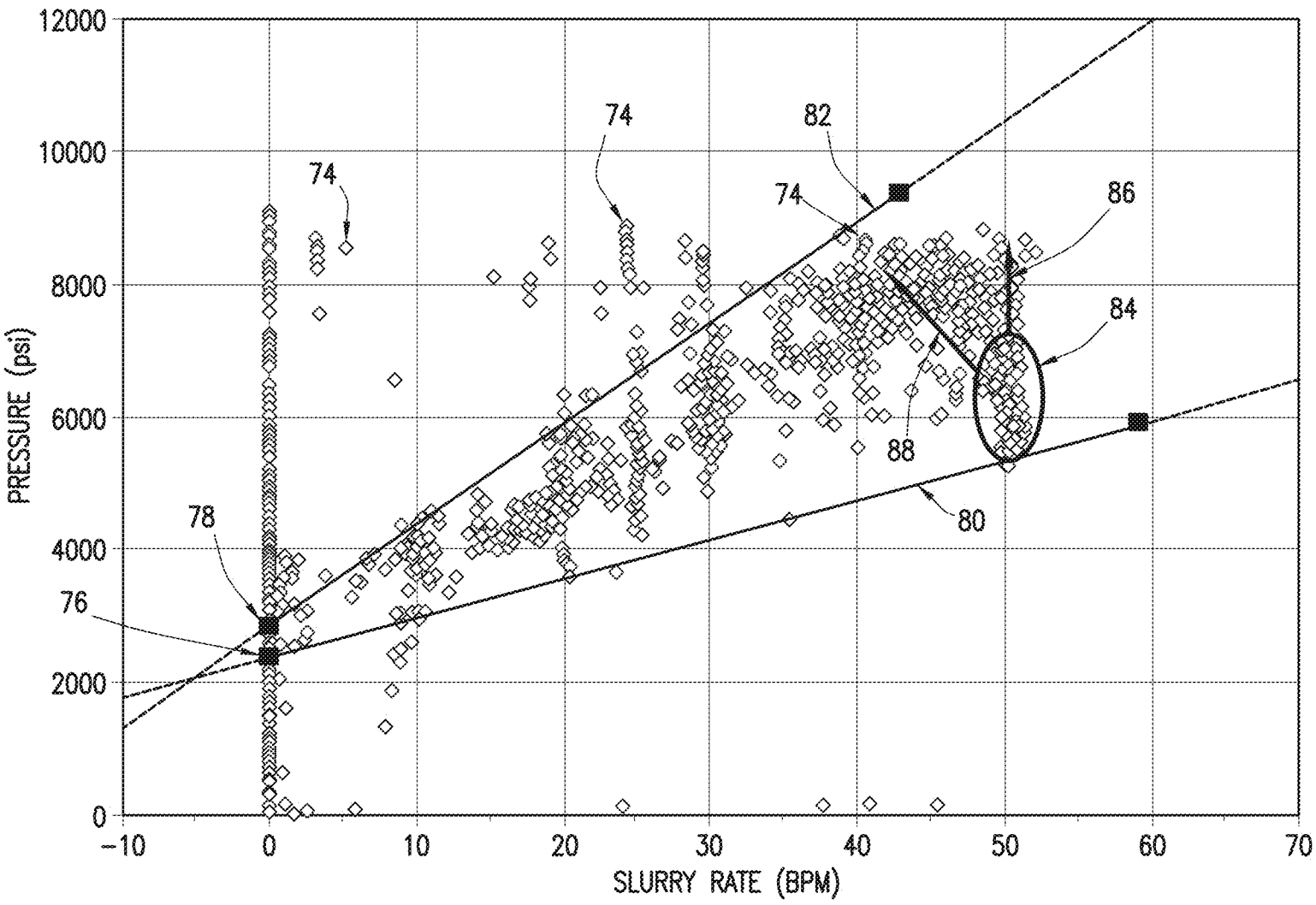
FIG. 10 is another representative plot of a slurry flow rate for a treatment fluid vs. pressure of the treatment fluid for a fracturing operation of a stage in another wellbore while a diverter material is being supplied to the fractures.

FIG. 10 illustrates how the current disclosure can be used to determine an integrity of a diverter formed during a diversion process. Data points 74 are collected as before and plotted to yield the parameters discussed above. The curves 80 and 82 are shown fitted to the new set of data points 74, with slopes and intercept points 76, 78 determined. As mentioned before, the cluster of data points 74, again shown clustered around ~50 BPM slurry rate, indicate the development of a fracture through the pressures and flow rates data points 74. The data points 74 clustered in the oval region 84 indicate a generally constant slurry rate with pressure increasing in the direction shown by arrow 86. This can be a result of the fracture being formed. When it is determined that the desired fracture geometries have been formed, then diverter material may be mixed in the fracturing fluid 70 and carried to the newly formed fracture.

As the diverter material is deposited in the fracture, the flow through the fracture should begin to be reduced even if the pressure increases, which is generally indicated by the arrow 88. If the clustering of data points 74 begin to populate the plot along the arrow 88, then this can indicate that the diverter material 72 being deposited (such as diverter particulates, proppant, etc.) in the newly formed fracture is beginning to restrict flow of the fracturing fluid 70 into the newly formed fracture, which can be the desired outcome for a diversion process. However, if the clustering of data points continues to populate the plot along the arrow 86, then this may indicate that the slurry rate of fluid 70 into the newly formed fracture is not being significantly impacted by the deposited diverter material. This can indicate that the diverter material 72 is not sufficiently restricting flow of fluid 70 into the newly formed fracture and that forming the next fracture with desired fracture geometries may not be possible until the flow restriction is improved. The real-time indication of the integrity of the diverter can initiate corrective actions in real-time to improve diversion, such as increase diverter particle size, change diverter particle concentration, change diverter particle material, etc.

A method of determining closure pressure in a wellbore is provided which can include operations for flowing a fracturing fluid into the wellbore during a fracturing operation of at least one stage of the wellbore, thereby forming a fracture at a location of the stage, sensing pressure in the wellbore via a sensor during the fracturing operation and communicating the sensed pressure data to a controller, sensing a flow rate of the fracturing fluid via a sensor during the fracturing operation and communicating the sensed flow rate data to the controller, with the controller plotting data points of the sensed pressure data vs. the sensed flow rate data to a visualization device which is configured to visually present the plotted data points to an operator as a plot, fitting a first curve to the data points which represent statistically-relevant minimum pressure data at various flow rates, determining an intercept of the first curve with a zero flow rate axis of the plot, and determining the closure pressure based on a pressure value of the intercept.

For any of the foregoing embodiments, the method may include any one of the following elements, alone or in combination with each other:

The operations can also include flowing the fracturing fluid into the wellbore during fracturing operations of multiple stages of the wellbore, plotting the data points for the fracturing operations of the multiple stages, and/or determining first and second closure pressures for respective first and second stages of the multiple stages, where the first and second closure pressures can be different.

The operations can also include determining an average half length of the fracture based on a slope of the first curve, determining a dynamic average width of the fracture based on the average fracture half length and the closure pressure, and/or determining a size of diverter particulates based on the dynamic average width.

The operations can also include fitting a second curve to data points which can represent statistically relevant maximum pressure data at various flow rates, determining an average fracture permeability based on the slope of the second curve, the average fracture half length, and the dynamic average width, and/or modifying a production operation based on the average fracture permeability, and/or determining at least one selected from the group consisting of a fracture conductivity, a fracture gradient, a fluid leakoff coefficient, a fluid efficiency, a formation permeability, a formation conductivity, a formation flow capacity, a reservoir pressure, and expected fracture geometries based on a combination of the average fracture permeability, the average fracture half length, and/or the dynamic average width.

The operations can also include carrying diverter particulates in the fracturing fluid and depositing the diverter particulates in the fracture, thereby diverting the fracturing fluid away from the fracture, where the plotting can further comprise plotting the data points as the diverter particulates are being deposited in the fracture and determining an integrity of a diversion formed by the deposited diverter particulates based on a progression of the plotted data points displayed on the plot.

The operations can also include where the closure pressure is based on measurements taken during the fracturing operation of the stage, and where a test fracturing operation is not required prior to beginning the fracturing operation of the at least one stage.

The operations can also include where the at least one stage comprises multiple stages and the closure pressure is adjusted based on the sensed pressure and flow rate data measured during fracturing operations of the multiple stages.

Another method for determining an integrity of a diversion in a multi-stage fracturing operation is provided which can include operations for flowing a fracturing fluid into the wellbore during a fracturing operation of a first stage of the wellbore, thereby forming a fracture at a location of the first stage, sensing fracturing fluid pressure via a sensor during the fracturing operation and communicating the sensed pressure data to a controller, sensing a flow rate of the fracturing fluid via a sensor during the fracturing operation and communicating the sensed flow rate data to the controller, the controller plotting data points of the sensed pressure data vs. the sensed flow rate data to a visualization device which is configured to visually present the plotted data points to an operator as a plot, carrying diverter particulates in the fracturing fluid and depositing the diverter particulates in the fracture, thereby diverting the fracturing fluid away from the fracture, plotting the data points as the diverter particulates are being deposited in the fracture and determining an integrity of a diversion formed by the deposited diverter particulates based on a progression of the plotted data points displayed on the plot.

For any of the foregoing embodiments, the method may include any one of the following elements, alone or in combination with each other:

The operations can also include where the fracturing fluid pressure is the pressure of the fracturing fluid at a downhole location, or where the fracturing fluid pressure is determined by sensing a pressure of the fracturing fluid proximate the earth's surface and compensating for hydrostatic/friction losses in the fracturing fluid as the fracturing fluid is pumped into the wellbore to approximate pressure of the fracturing fluid at a downhole location.

Furthermore, the illustrative methods described herein may be implemented by a system comprising processing circuitry that can include a non-transitory computer readable medium comprising instructions which, when executed by at least one processor of the processing circuitry, causes the processor to perform any of the methods described herein.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. A method of determining closure pressure in a wellbore, the method comprising:

flowing a proppant laden fracturing fluid into the wellbore during a fracturing operation of at least one stage of the wellbore to build up a pressure of the fracturing fluid thereby forming a fracture at a location of the stage;

depositing diverter particulates in the fracture;

sensing pressure in the wellbore via a sensor during the fracturing operation and communicating the sensed pressure data to a controller;

sensing a flow rate of the fracturing fluid via a sensor during the fracturing operation and communicating the sensed flow rate data to the controller;

the controller plotting data points of the sensed pressure data vs. the sensed flow rate data to a visualization device which is configured to visually present the plotted data points to an operator as a plot;

fitting a first curve to the data points which represent statistically-relevant minimum pressure data at various flow rates;

determining an intercept of the first curve with a zero flow rate axis of the plot;

determining the closure pressure based on a pressure value of the intercept, and adjusting a parameter of the fracturing fluid based on the sensed pressure and flow rate data measured during the fracturing operations while the fracture is being formed.

2. The method of claim 1, wherein the flowing further comprising flowing the fracturing fluid into the wellbore during the fracturing operations of multiple stages of the wellbore.

3. The method of claim 2, wherein plotting the data points comprises plotting the data points for the fracturing operations of the multiple stages.

4. The method of claim 3, wherein determining the closure pressure further comprises determining first and second closure pressures for respective first and second stages of the multiple stages.

5. The method of claim 4, wherein the first and second closure pressures are different.

6. A method of determining closure pressure in a wellbore, the method comprising:

flowing a fracturing fluid into the wellbore during a fracturing operation of at least one stage of the wellbore, thereby forming a fracture at a location of the stage:

sensing pressure in the wellbore via a sensor during the fracturing operation and communicating the sensed pressure data to a controller;

sensing a flow rate of the fracturing fluid via a sensor during the fracturing operation and communicating the sensed flow rate data to the controller;

the controller plotting data points of the sensed pressure data vs. the sensed flow rate data to a visualization device which is configured to visually present the plotted data points to an operator as a plot;

fitting a first curve to the data points which represent statistically-relevant minimum pressure data at various flow rates;

determining an intercept of the first curve with a zero flow rate axis of the plot;

determining the closure pressure based on a pressure value of the intercept; and determining an average half length of the fracture based on a slope of the first curve.

7. The method of claim 6, further comprising determining a dynamic average width of the fracture based on the average fracture half length and the closure pressure.

8. The method of claim 7, further comprising determining a size of diverter particulates based on the dynamic average width.

9. The method of claim 7, further comprising fitting a second curve to data points which represent statistically-relevant maximum pressure data at various flow rates.

10. The method of claim 9, further comprising determining an average fracture permeability based on a slope of the second curve, the average fracture half length, and the dynamic average width.

11. The method of claim 10, further comprising modifying a production operation based on the average fracture permeability.

12. The method of claim 10, further comprising determining at least one selected from the group consisting of a fracture conductivity, a fracture gradient, a fluid leakoff coefficient, a fluid efficiency, a formation permeability, a formation conductivity, a formation flow capacity, a reservoir pressure, and expected fracture geometries based on a combination of the average fracture permeability, the average fracture half length, and/or the dynamic average width.

13. The method of claim 6, further comprising carrying diverter particulates in the fracturing fluid and depositing the diverter particulates in the fracture, thereby diverting the fracturing fluid away from the fracture, and wherein the plotting further comprises plotting the data points as the diverter particulates are being deposited in the fracture and determining an integrity of a diversion formed by the deposited diverter particulates based on a progression of the plotted data points displayed on the plot.

14. The method of claim 1, wherein the plotting further comprises plotting the data points as the diverter particulates are being deposited in the fracture and determining an integrity of a diversion formed by the deposited diverter particulates based on a progression of the plotted data points displayed on the plot.

15. The method of claim 1, wherein the closure pressure is based on measurements taken during the fracturing operations of multiple stages.

* * * * *